US008469008B2

(12) United States Patent
Powell et al.

(10) Patent No.: US 8,469,008 B2
(45) Date of Patent: Jun. 25, 2013

(54) RETURN FUEL DIFFUSION DEVICE AND FUEL GUIDE

(75) Inventors: Patrick Powell, Farmington Hills, MI (US); J. Blair Miller, Harrison Township, MI (US)

(73) Assignees: DENSO International America, Inc., Southfield, MI (US); Denso Corporation, Kariya-shi (JP)

( * ) Notice: Subject to any disclaimer, the term of this patent is extended or adjusted under 35 U.S.C. 154(b) by 859 days.

(21) Appl. No.: 12/640,918

(22) Filed: Dec. 17, 2009

(65) Prior Publication Data

US 2011/0146628 A1 Jun. 23, 2011

(51) Int. Cl.
*F02M 37/04* (2006.01)
*F02M 37/00* (2006.01)

(52) U.S. Cl.
USPC ..... 123/509; 123/514

(58) Field of Classification Search
USPC ..... 123/509, 514
See application file for complete search history.

(56) References Cited

U.S. PATENT DOCUMENTS 416,303 A * 12/1889 Snedden ..... 40/370
2,878,889 A * 3/1959 Gilbert ..... 96/174
4,205,643 A * 6/1980 Vidal ..... 123/530
4,385,615 A * 5/1983 Keane ..... 123/514
4,672,937 A * 6/1987 Fales et al. ..... 123/509
4,886,031 A * 12/1989 Scheurenbrand et al. .... 123/516
4,893,647 A * 1/1990 Tuckey ..... 137/493
5,050,567 A * 9/1991 Suzuki ..... 123/514
5,070,849 A * 12/1991 Rich et al. ..... 123/509
5,133,324 A * 7/1992 Michiaki ..... 123/514
5,146,901 A * 9/1992 Jones ..... 123/516
5,431,143 A * 7/1995 Brown ..... 123/514
5,456,235 A * 10/1995 Porter ..... 123/509
5,533,486 A * 7/1996 Qutub ..... 123/541
5,647,330 A 7/1997 Sawert et al.
5,785,084 A * 7/1998 Richter et al. ..... 137/549
6,058,911 A * 5/2000 Hashimoto et al. ..... 123/514
6,705,298 B2 * 3/2004 Ramamurthy et al. ..... 123/509
6,883,500 B2 4/2005 Powell et al.
6,886,541 B2 5/2005 Powell
6,904,928 B2 6/2005 Powell et al.
6,928,989 B2 8/2005 Powell (Continued)

OTHER PUBLICATIONS

Office Action dated Apr. 27, 2012 in corresponding DE application No. 102010061220.0 with English translation thereof.

*Primary Examiner* — Stephen K Cronin
*Assistant Examiner* — Raza Najmuddin
(74) *Attorney, Agent, or Firm* — Harness, Dickey & Pierce, P.L.C.

(57) ABSTRACT

A fuel pump module mounted to a fuel tank may employ a flange on a top surface of the fuel tank, a fuel inlet pipe that passes through the flange, a fuel reservoir situated near a bottom interior surface of the fuel tank, and a fuel diffuser, which may be attached to the fuel inlet pipe, that protrudes away from the flange into an interior volume of the reservoir. A fuel cylinder may surround at least part of a longitudinal length of the fuel diffuser to control passage of fuel and bubbles and may have a first end that is open and a second end that is attached to a top surface of a bottom wall of the reservoir. Alternatively, the fuel cylinder may be attached at a first end to the fuel inlet pipe and define a second end that is open such that the fuel cylinder and a reservoir bottom define a gap therebetween.

17 Claims, 8 Drawing Sheets

U.S. PATENT DOCUMENTS 7,121,266 B2 10/2006 Powell
7,210,465 B2 * 5/2007 Ikeya ..... 123/510
7,216,633 B2 5/2007 Attwood et al.
2001/0023687 A1 * 9/2001 Ushigome ..... 123/509
2006/0021603 A1 * 2/2006 Nagata ..... 123/514
2010/0065023 A1 * 3/2010 Villaire et al. ..... 123/514

* cited by examiner

RETURN FUEL DIFFUSION DEVICE AND FUEL GUIDE

FIELD

The present disclosure relates to a structure to diffuse fuel and associated heat of fuel within a fuel tank.

BACKGROUND

This section provides background information related to the present disclosure which is not necessarily prior art. Modern fuel systems, such those used in diesel engine fuel systems, may utilize a return fuel line from a fuel injection pump to a traditional fuel tank. After passing through the fuel injection pump, fuel unnecessary for combustion absorbs heat from the fuel injection pump and is returned to the fuel tank. One limitation of returning warmed fuel to the fuel tank pertains to its return as a consolidated stream at a location proximate an intake location of an in-tank fuel pump. With a warmed, consolidated fuel stream proximate an intake location of the fuel pump, return fuel may immediately be drawn into the fuel pump when a vehicle engine is operating. Pumping warmed fuel through the fuel pump and fuel system at a temperature above a recommended operating temperature may result in decreased service life for various components of the fuel delivery system, such as fuel filters, engine mounted pumps, and fuel feed lines.

What is needed then is a device that does not suffer from the above limitations.

SUMMARY

This section provides a general summary of the disclosure, and is not a comprehensive disclosure of its full scope or all of its features. A fuel pump module that mounts to a fuel tank may employ a flange that resides on a top surface of the fuel tank, a fuel inlet pipe that passes through the flange to return fuel from an engine and into the fuel tank, and more specifically, to return fuel to the fuel pump module. A fuel pump module reservoir may reside proximate to or against a bottom interior surface of the fuel tank and receive returned fuel. A fuel diffuser may be attached to the fuel inlet pipe to receive liquid fuel through an interior of the fuel diffuser from the fuel inlet pipe. The fuel diffuser may protrude into an interior volume of the reservoir and be surrounded, partially or completely, by a fuel cylinder, which acts as a fuel and vapor guide.

The fuel cylinder may surround part of the longitudinal length or all of the longitudinal length of the fuel diffuser to control the flow of liquid fuel and any bubbles generated in a volume between the fuel cylinder and the fuel diffuser. The fuel cylinder may define a first end that is open (non-closed) and a second end that is attached to a top surface of a bottom wall of the reservoir. The fuel diffuser and a reservoir bottom may define a gap therebetween to facilitate the continuous flow of fuel into the reservoir. The fuel cylinder may define an open top to permit escape of any bubbles to a volume not occupied by liquid fuel, such as a volume directly above the reservoir. The fuel cylinder may define at least one hole (e.g. round rectangular, etc.) in a sidewall of the fuel cylinder for exit of liquid fuel. A jet pump supply tube may be connected to the fuel inlet pipe and lead to a jet pump located within the fuel pump module reservoir.

In another arrangement, the fuel cylinder may have a first end that is attached to the fuel inlet pipe and a second end that is open (non-closed). The first end of the fuel cylinder may exhibit a flat surface surrounding the fuel inlet pipe. The flat surface may also define at least one through hole to permit the passage of bubbles rising from the volume of liquid fuel to escape to a volume not occupied by liquid fuel within the fuel tank.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
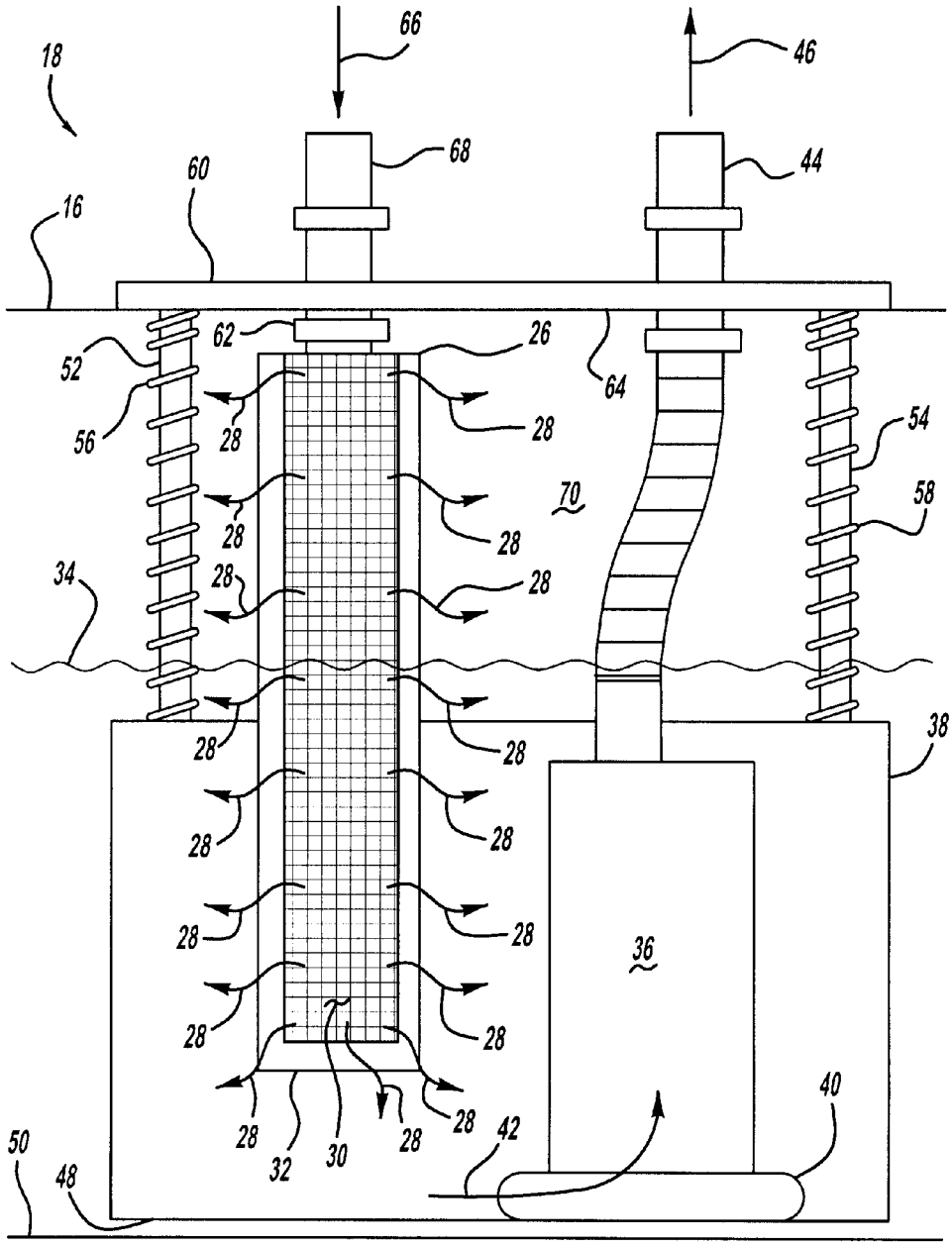
Figure 4:
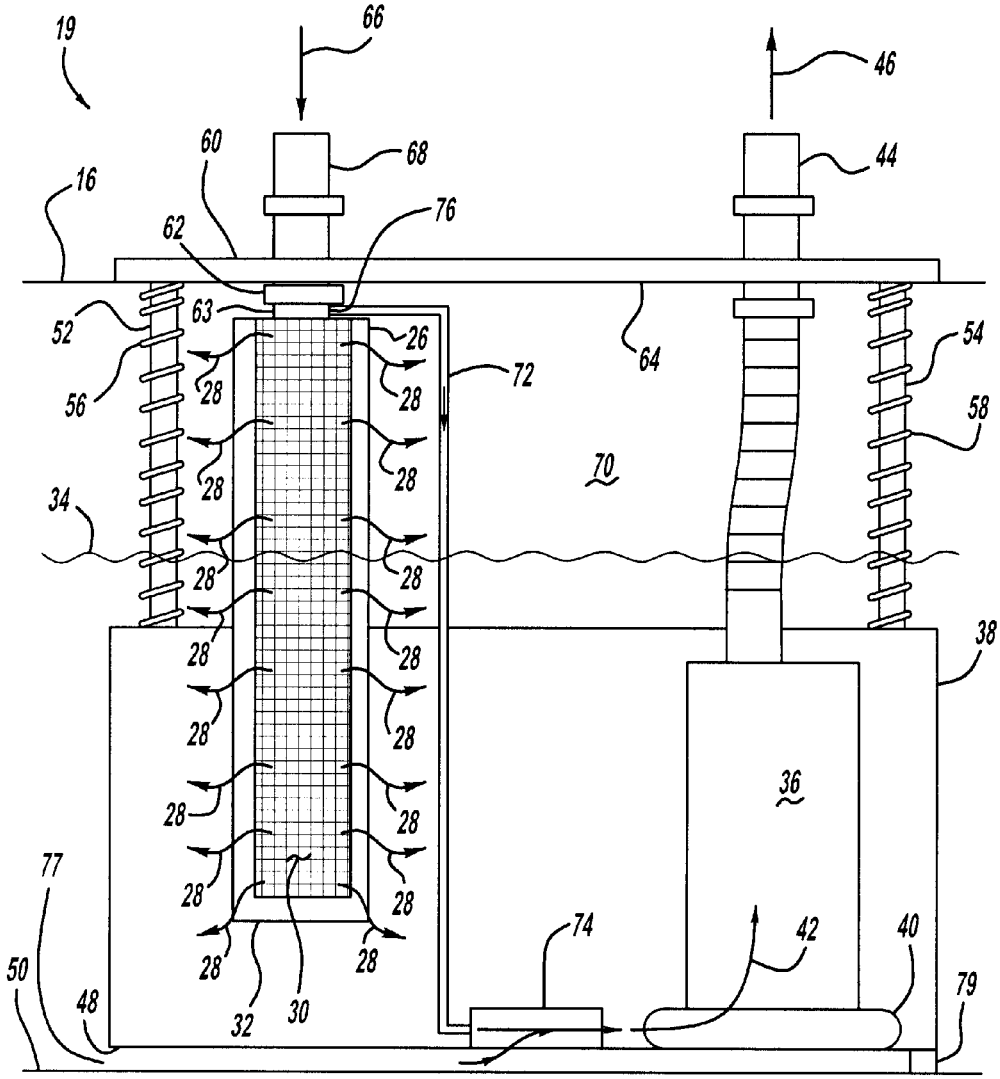
Figure 5:
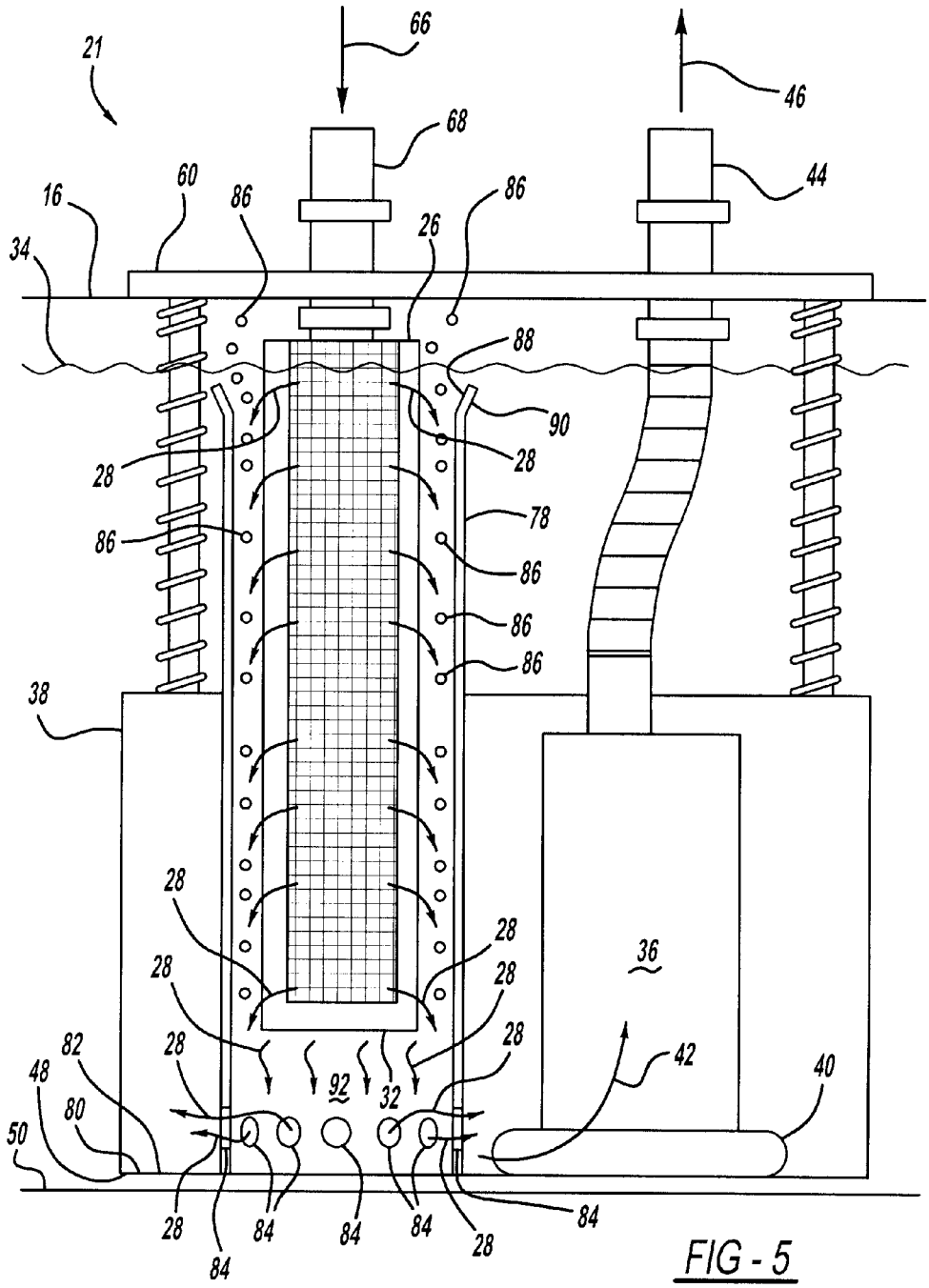
Figure 6:
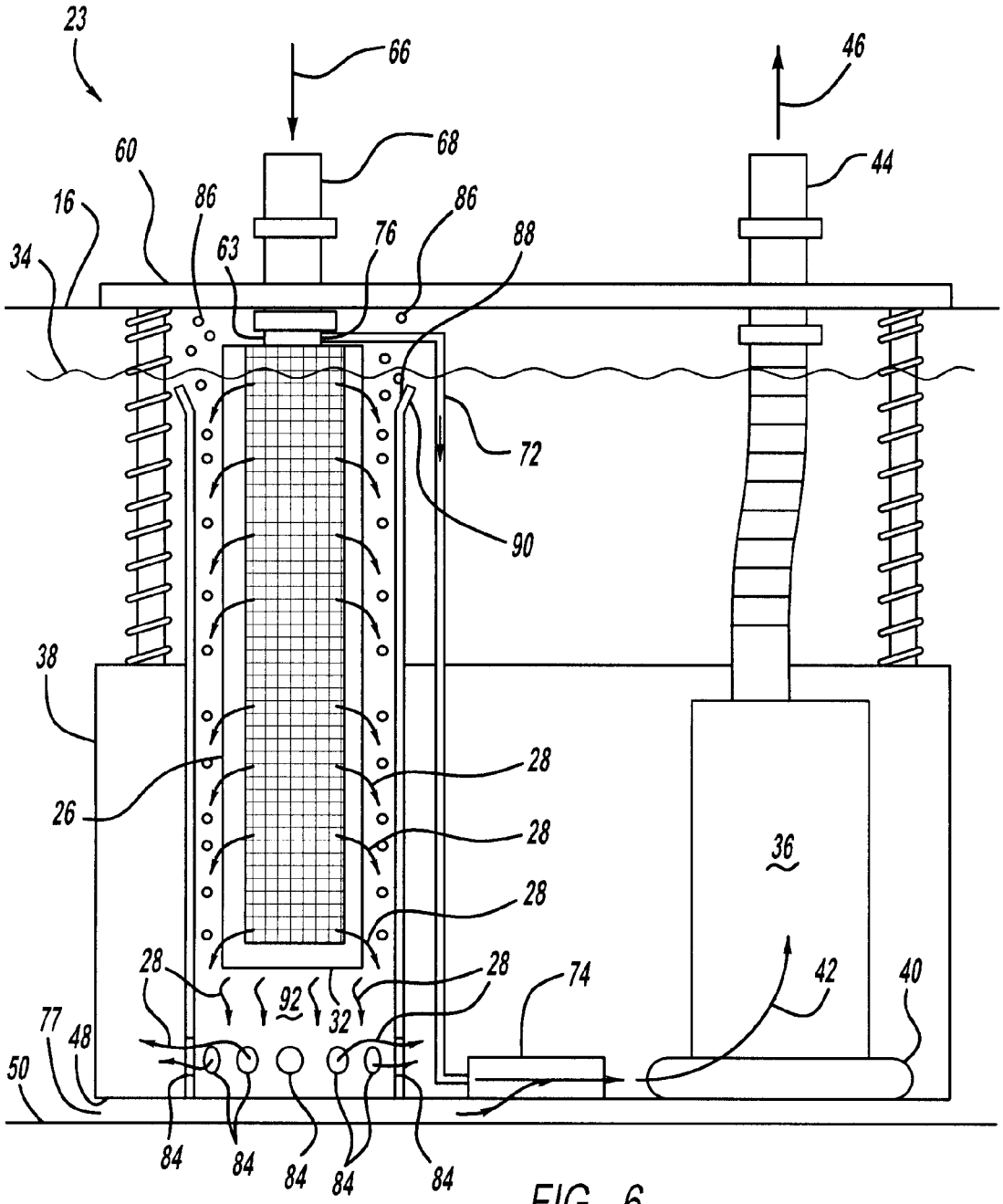
Figure 7:
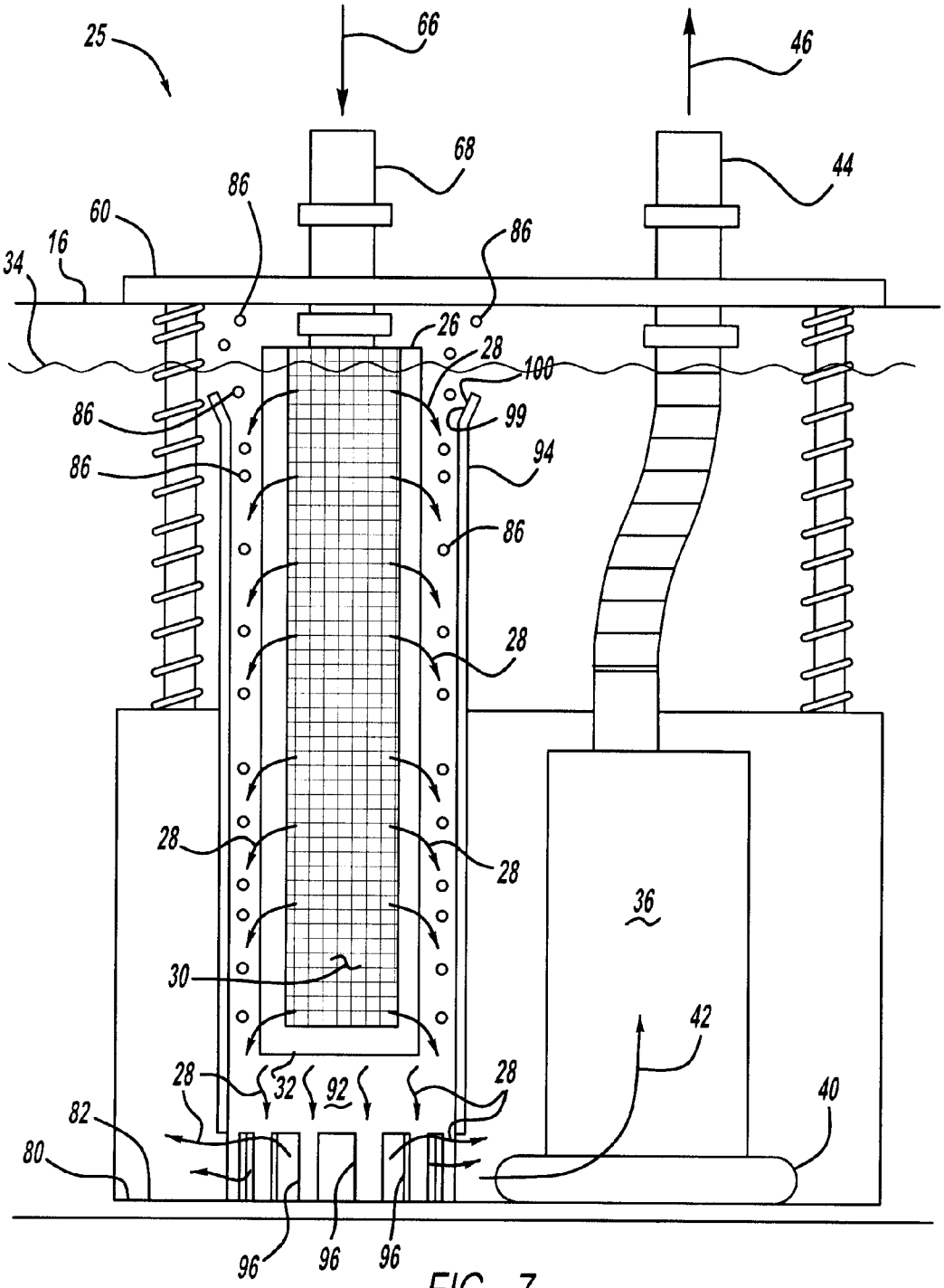
Figure 8:
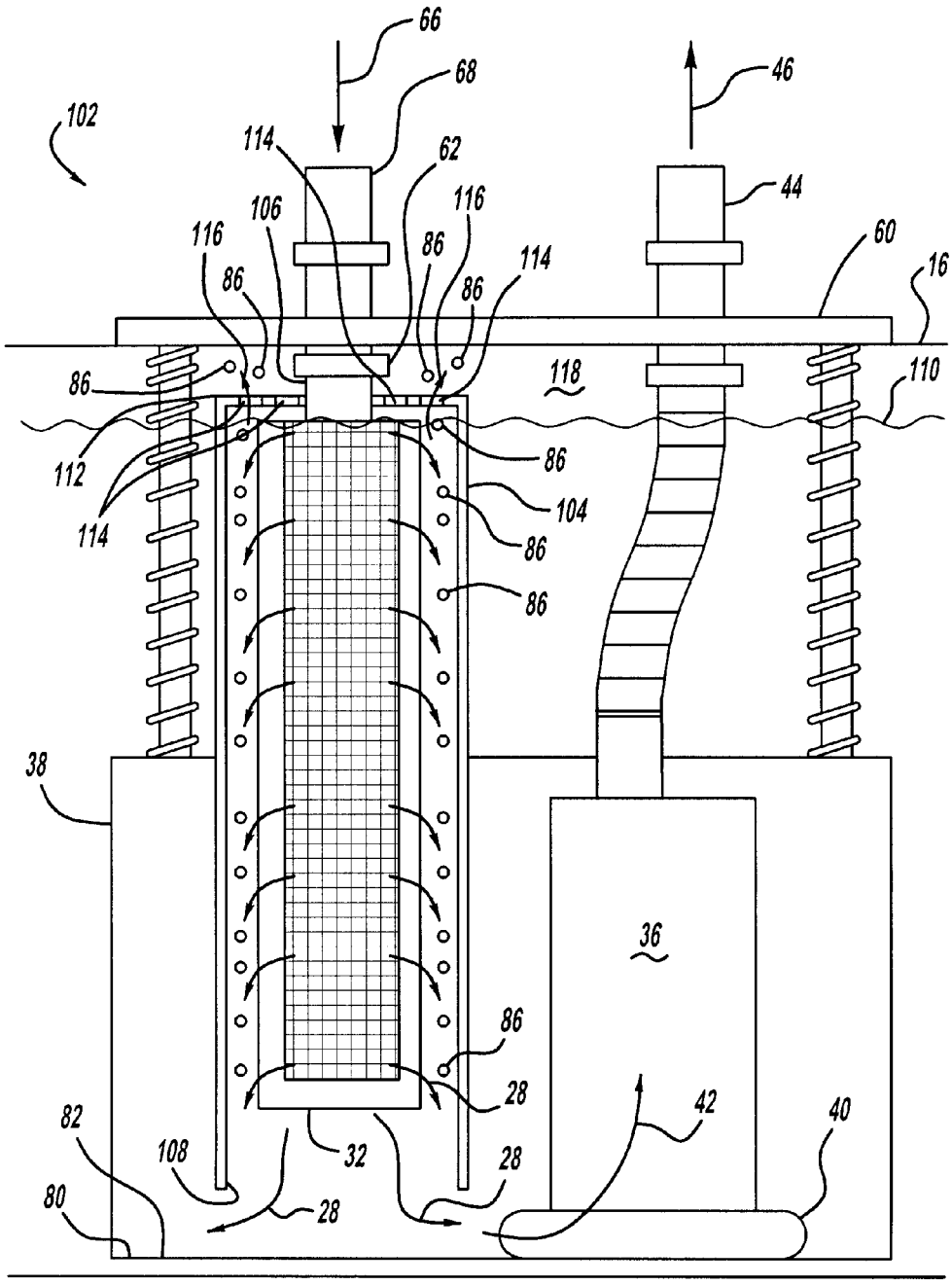
Figure 9:
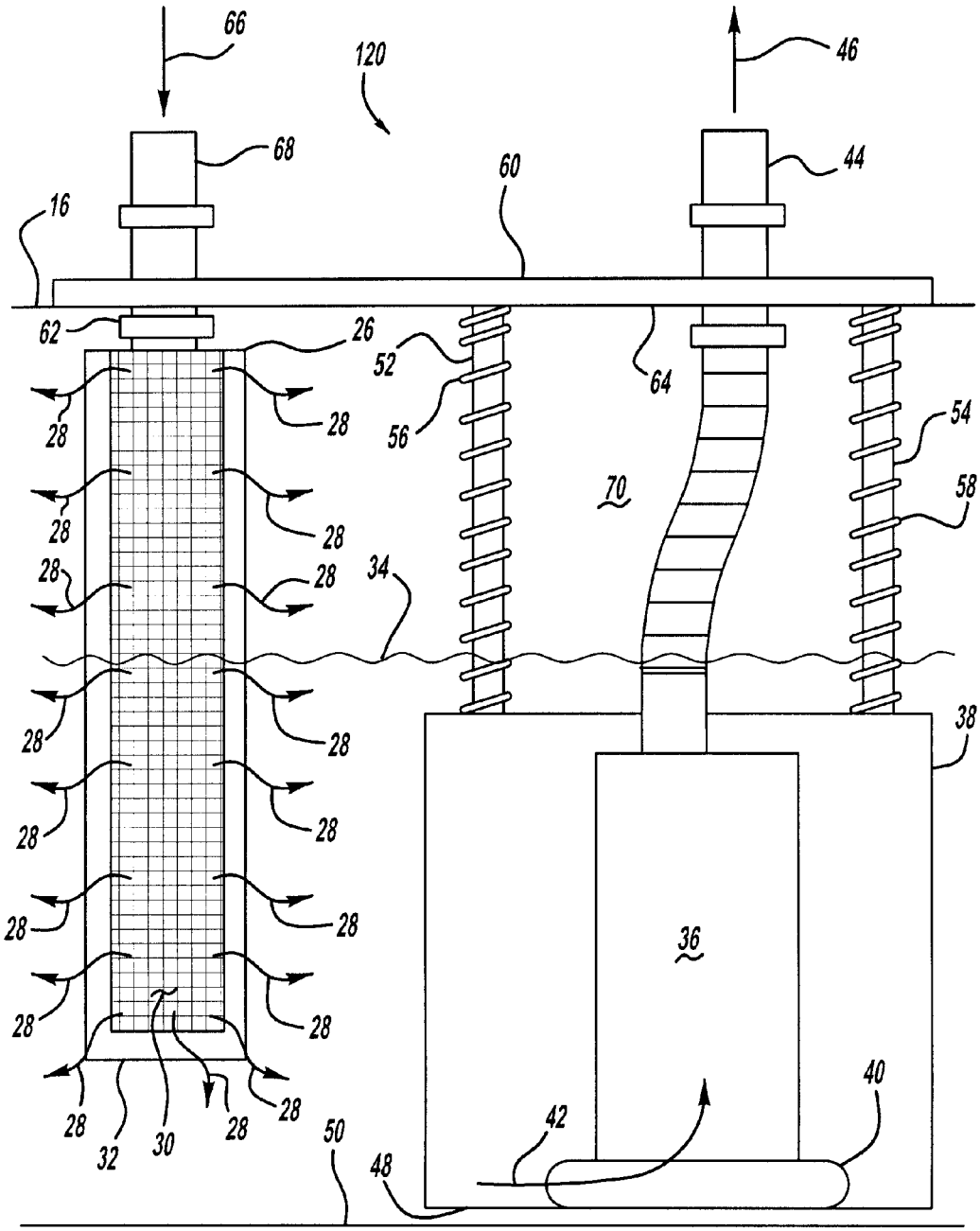

FIG. 3, in accordance with a first embodiment of the disclosure, is an enlarged view of a fuel pump module depicting a fuel diffuser;

FIG. 4, in accordance with a second embodiment of the disclosure, is an enlarged view of a fuel pump module depicting the fuel diffuser of FIG. 3 and a jet pump supply line with a jet pump;

FIG. 5, in accordance with a third embodiment of the disclosure, is an enlarged view of a fuel pump module depicting a fuel diffuser;

FIG. 6, in accordance with a fourth embodiment of the disclosure, is an enlarged view of a fuel pump module depicting a fuel diffuser of FIG. 5 and additionally a jet pump supply line with a jet pump;

FIG. 7, in accordance with a fifth embodiment of the disclosure, is an enlarged view of a fuel pump module depicting a fuel diffuser;

FIG. 8, in accordance with a sixth embodiment of the disclosure, is an enlarged view of a fuel pump module depicting a fuel diffuser; and FIG. 9, in accordance with a seventh embodiment of the disclosure, is an enlarged view of a fuel pump module depicting an offset fuel diffuser.

Corresponding reference numerals indicate corresponding parts throughout the several views of the drawings.

DETAILED DESCRIPTION

Figure 1:
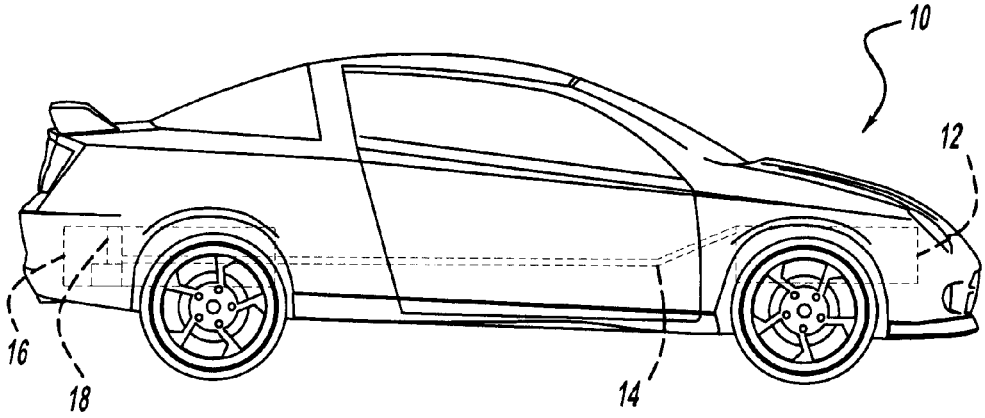
FIG. 1 is a side view of a vehicle depicting a fuel system in phantom.

Example embodiments of the present disclosure may be applied to gasoline, diesel and other liquid fuel systems. Such embodiments will now be described more fully with reference to FIGS. 1-9. FIG. 1 depicts a vehicle 10, such as an automobile, having an engine 12, a fuel supply line 14, a fuel tank 16, and a fuel pump module 18. Fuel pump module 18 mounts within fuel tank 16 and is normally submerged in or surrounded by varying amounts of liquid fuel. A fuel pump within the fuel pump module 18 pumps fuel to engine 12 through fuel supply line 14.

Figure 2:
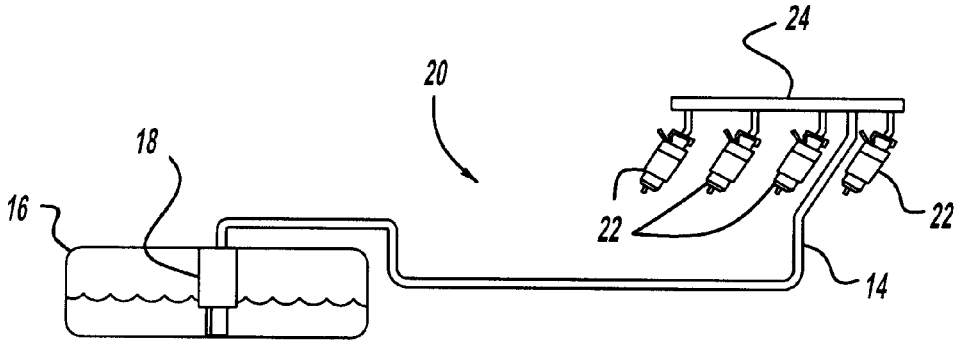
FIG. 2 is an enlarged view of a vehicle fuel system, such as a diesel fuel system.

FIG. 2 is a perspective view of a fuel supply system 20 depicting fuel injectors 22. In a vehicle fuel system, a fuel supply line 14 may carry fuel between fuel pump module 18 and a common fuel injector rail 24. Once fuel reaches injector rail 24, also called a "common rail," fuel may pass into individual fuel injectors 22 before being sprayed or injected into individual combustion chambers of internal combustion engine 12. Fuel supply system 20 depicted in FIG. 2 does not depict a fuel return line to the fuel tank 16. However, a fuel return line may exist in return fuel systems, which may be utilized in gasoline and diesel systems.

FIG. 3 depicts a fuel pump module 18 in which flange fuel exit 44 discharges fuel represented by arrow 46 that may be carried to fuel supply line 14, depicted in FIG. 2. Depending upon the type of return fuel system employed, return fuel represented by arrow 66 will be returned to fuel tank 16 via flange fuel inlet 68. FIG. 3 depicts fuel pump module 18 with a fuel diffuser 26, which may be utilized for diffusing liquid fuel and associated heat possessed by such liquid fuel. For brevity, "fuel diffuser 26" will be referred to as "diffuser 26" throughout this description. Continuing, FIG. 3 depicts diffuser 26 and during use, holes or orifices permit fuel to exit along an entire longitudinal length of diffuser 26 from an interior of diffuser 26 to an exterior of diffuser 26. Moreover, because diffuser 26 may be porous and may utilize a material such as a screen 30 or a material suitable for filtering fuel to remove debris from liquid fuel, liquid fuel may pass through diffuser 26, as indicated by arrows 28. Returned liquid fuel may also pass from an end 32 of diffuser 26, at a point of diffuser 26 farthest from clamp 62. End 32 may or may not have orifices the same size as the sides of diffuser 26.

An advantage of using diffuser 26 to introduce or reintroduce fuel into reservoir 38 of fuel pump module 18 of fuel tank 16, is that any fuel passing through and from diffuser 26 will be dispersed or distributed away from an intake of fuel pump 36, such as at fuel filter sock 40, yet within or above fuel reservoir 38, depending upon the level of fuel (e.g. fuel level 34) in fuel tank 16. This will permit warmed fuel to mix with fuel at a lower temperature that already exists in fuel tank 16 of reservoir 38. Another advantage of dispersing fuel from an elongate diffuser such as diffuser 26 is that any air bubbles resulting from such reintroduction of fuel into reservoir 38 will also be diffused or dispersed away from fuel filter sock 40. Air bubbles may adversely affect performance or life of fuel pump 36 or other fuel line components. Warmed fuel may contribute to premature failure and wear of fuel pump 36 and premature failure and wear of other fuel system components. Fuel drawn into fuel filter sock 40 is indicated with arrow 42 and fuel that exits fuel pump 36 and through flange fuel exit 44 is indicated with arrow 46. Diffuser 26 may function as a fuel filter to further clean liquid fuel as it is returned to fuel pump module reservoir 38.

Continuing with FIG. 3, a bottom surface 48 of fuel reservoir 38 may be secured against or nearly against a bottom inside surface 50 of fuel tank 16 with support rods 52, 54 and a corresponding spring 56, 58 for each of rods 52, 54. Diffuser 26 may be attached to flange 60 of fuel pump module 18 such that diffuser 26 is suspended or hangs from flange 60 without contacting any other structure. Alternatively, within fuel tank 16 and fuel pump module 18, diffuser 26 may be affixed to flange fuel inlet 68 with a clamp 62 so that diffuser protrudes away from face 64 of flange 60 into an interior volume of reservoir 38. Diffuser 26 may be partially or completely submerged in liquid fuel, such as below fuel level 34. Submersion depth of diffuser 26 depends upon the level of fuel 34 within tank 16 and overall length of diffuser 26. In operation, return fuel as indicated by arrow 66 enters flange fuel inlet 68 and passes through flange 60 and into diffuser 26 where fuel indicated by arrows 28 then passes from diffuser 26 and into reservoir 38 or into an area 70 above reservoir 38 and becomes part of fuel level 34. Flange fuel inlet 68 may pass through flange 60 as a separate piece or be integrally molded into or as part of flange 60.

FIG. 4 depicts fuel pump module 19 with a jet pump supply line 72 and an associated jet pump 74. More specifically, a neck 63 between diffuser 26 and clamp 62 may receive jet pump supply line 72, which may or may not be molded as part of neck 63 or diffuser 26. Jet pump supply line 72 may employ a horizontal or generally horizontal tube that leads from a fuel outlet 76 at neck 63 at an upper portion of diffuser 26 to prevent some quantity of fuel from passing farther into diffuser 26 and to instead be diverted to jet pump 74. Jet pump supply line 72 may divert fuel from diffuser 26 just below clamp 62 and be integrally molded as part of diffuser 26. By utilizing force from return fuel just prior to entering diffuser 26, jet pump 74 may be used to create a vacuum force and draw fuel resident in a gap 77 formed between reservoir bottom surface 48 and bottom inside surface 50 of fuel tank 16. As an example, a wall 79 on bottom surface 48 may be utilized to create gap 77 for fuel to operate jet pump 74; however, other reservoir bottom designs are possible to create gap 77. Such structures are absent from other figures.

FIG. 5 depicts fuel pump module 21 with diffuser 26 resident within a cylinder 78 having an open (i.e. non-closed) top. More specifically, cylinder 78 may be integrally molded to, or molded as part of, a top surface 80 of a bottom wall 82 (i.e. interior bottom surface) of reservoir 38. Alternatively, cylinder 78 may be separately attached to top surface 80. Fuel cylinder 78 may reside or be located completely around part of a length of fuel diffuser 26 (e.g. less than fifty percent (half), more than fifty percent (half), etc.) or reside around an entire length (e.g. one hundred percent) of diffuser 26. Regardless of how cylinder 78 is manufactured or attached to reservoir 38, cylinder 78 may be equipped with one or more through holes 84, such as circular or rectangular holes, such as at a bottom of cylinder 78. As depicted in FIG. 5, apertures or through holes 84 in cylinder 78 sidewall permit liquid fuel, depicted with arrows 28, to move from an interior of cylinder 78 to an exterior of cylinder 78 as fuel from flange fuel inlet 68 fills diffuser 26 and cylinder 78. Depending upon the fuel system within which a fuel pump module is installed, apertures or through holes 84 may be located anywhere along a length of cylinder 78. Thus, for the arrangement depicted in FIG. 5, cylinder 78 has a purpose of guiding or directing fuel to through holes 84 at a cylinder bottom wall 82. Moreover, cylinder 78 also has a purpose of permitting bubbles 86 to escape from a top mouth 88 of cylinder 78. More specifically, at the same time that fuel pump 36 is pumping fuel from within reservoir 38 to engine 12, unused or return fuel represented by arrow 66 enters diffuser 26 and is discharged from a periphery and length of diffuser 26. As liquid fuel depicted with arrows 28 exits screen 30 or other filter material of diffuser 26, bubbles 86 may be created by any laminar or turbulent fluid flow, such as during contact of liquid fuel with a fuel level 34 in fuel tank 16, or contact with any fuel pump module part.

Continuing with FIG. 5, as bubbles 86 form, instead of possibly being drawn into fuel pump 36 in the absence of cylinder 78, bubbles 86 will rise in a volume between diffuser 26 and cylinder 78, such as toward top mouth 88 of cylinder 78. Thus, bubbles 86 may escape from a top of cylinder 78 while being prevented from being drawn into fuel pump 36. Top mouth 88 of cylinder 78 may be flared such that a diameter at end 90 of cylinder 78 is larger than the balance of cylinder 78. Cylinder 78 may or may not contact any portion of diffuser 26 and diffuser 26 may be entirely or partially contained within a curved, cylindrical wall that forms cylinder 78. Diffuser 26 and cylinder 78 may be a circle in cross-section. End 32 of diffuser 26 may reside above top surface 80 of bottom wall 82 of reservoir 38 such that a gap 92 exists between top surface 80 and a flat surface of end 32.

FIG. 6 depicts a fuel pump module 23 that the arrangement of FIG. 5 with additions of jet pump supply line 72 and associated jet pump 74. More specifically, diffuser 26 may employ jet pump supply line 72, which may or may not be molded as part of diffuser 26, that leads to jet pump 74. Jet pump supply line 72 may employ a horizontal or generally horizontal portion that leads from a fuel outlet 76 at neck 63 at upper portion of diffuser 26 to prevent fuel from passing farther into diffuser 26 and to instead be diverted to jet pump 74. Jet pump supply line 72 may divert a volume of fuel from diffuser 26 just below clamp 62 and may be integrally molded as part of diffuser 26. By utilizing force from return fuel just prior to entering diffuser 26, jet pump 74 may be used to create a vacuum force and draw fuel from a gap 77 formed between bottom surface 48 and bottom inside surface 50 of fuel tank 16.

FIG. 7 depicts fuel pump module 25 with another arrangement of diffuser 26 and a cylinder 94. More specifically, cylinder 94 may surround an entire length or part of a length of diffuser 26 and have one or more rectangular apertures 96 located at a bottom of cylinder 94. Liquid fuel may pass through apertures 96 after being returned to fuel tank 16 through flange fuel inlet 68 and passing through diffuser 26 and out of screen 30, which may be a filter material, for example. By locating rectangular apertures 96 at a bottom of cylinder 94 and adjacent a top surface 80 of bottom wall 82, or with bottom wall 82 of reservoir 38 actually forming at least one side of a boundary of each aperture 96, liquid fuel may be released against bottom wall 82 at a bottom of reservoir 38. Similar to the arrangement depicted in FIG. 5, cylinder 94 also has a purpose of permitting bubbles 86 to escape from a top mouth of cylinder 94. More specifically, at the same time that fuel pump 36 is pumping fuel from within reservoir 38 to engine 12, unused or return fuel represented by arrow 66 enters diffuser 26 and is discharged from a periphery and length of diffuser 26. As liquid fuel depicted with arrows 28 exits screen 30 or other small apertures of diffuser 26, bubbles 86 may be created by any laminar or turbulent fluid flow, such as contact with liquid fuel level 34 in fuel tank 16.

Continuing with FIG. 7, as bubbles 86 form, instead of possibly being drawn into fuel pump 36 in the absence of cylinder 94, bubbles 86 will rise in an area between diffuser 26 and cylinder 94, such as toward top mouth 99 of cylinder 94. Thus, bubbles may escape from a top of cylinder 94 while being prevented from being drawn into fuel pump 36. Top mouth 99 of cylinder 94 may be flared such that an end diameter 100 of cylinder 94 is larger than the balance of cylinder 94. Cylinder 94 may or may not contact any portion of diffuser 26 and diffuser 26 may be entirely or partially contained within a curved, cylindrical wall (when viewed in cross section) that forms cylinder 94. End 32 of diffuser 26 may reside above top surface 80 of bottom wall 82 of reservoir 38 such that a gap 92 exists between top surface 80 and a flat surface of end 32.

FIG. 8 depicts a view of a fuel pump module 102 in another arrangement of the disclosure. More specifically, fuel pump module 102 employs a diffuser 26 within a cylinder 104, which controls the flow of fuel that exits from diffuser 26 and which controls bubbles 86 generated by fuel within diffuser 26 or bubbles 86 generated by fuel upon exiting diffuser 26. Cylinder 104 may be arranged over an entire longitudinal length of diffuser 26 or over part of a length of diffuser 26. Still yet, cylinder 104 may be longitudinally longer than diffuser 26 such that cylinder 104 protrudes past a flat surface at an end 32 of diffuser 26 with diffuser 26 completely resident or contained within cylinder 104. Cylinder 104 may have an end that defines an aperture 108 that has an inside and outside diameter that is the same as an inside and outside diameter of an entire length of cylinder 104. With aperture 108 at an end of cylinder 104, liquid fuel may flow outside of cylinder 104 and merge with a volume of fuel 110 already resident in reservoir 38.

Continuing with FIG. 8, cylinder 104 has another function, which is to direct of guide bubbles 86 away from fuel pump 36 and to a top 112 of cylinder 104, which may be a cylinder end opposite that of cylinder end 32. More specifically, when bubbles 86 form around diffuser 26, cylinder 104 prevents such bubbles 86 from being drawn into fuel pump 36, and instead directs bubbles to a cylinder top 112 where bubbles 86 are permitted to pass completely through one or more through holes 114 in accordance with arrows 116 and emerge from liquid fuel 110 into gaseous space 118. Cylinder 104 may attach to an interior fuel inlet pipe 106 at an interior of fuel pump module 102, such as just below a clamp 62 and flange 60. Cylinder 104 may be integrally molded to interior fuel inlet pipe 106 or attached to interior fuel inlet pipe 106 as a separate piece, such as by welding.

FIG. 9 depicts a view of a fuel pump module 120 in another arrangement. More specifically, fuel pump module 120 employs a diffuser 26 offset, such as situated completely beside, reservoir 38. and not over, not above and not inside reservoir 38. Fuel pump module 120 with an offset diffuser 26 has an advantage related to packaging within fuel tank 16 and dispersion of heat in return fuel represented by arrow 66. More specifically, because diffuser 26 is located outside of reservoir 38, which is farther from fuel pump 36 than if diffuser 26 were located within reservoir 38, heat from return fuel is initially dispersed outside of reservoir 38. Moreover, vaporous bubbles generated by return fuel being deposited into fuel 34 within fuel tank 16 are also prevented from being drawn into fuel pump 36 via fuel filter 40, since bubbles are will rise to area 70 before reaching fuel pump 36. Structurally, besides a position of fuel diffuser 26 outside of reservoir 38 and advantages linked to such offset structure, components of fuel pump module 120 are similar to that described in conjunction with FIG. 3.

Advantages of the disclosure discussed above with reference to FIGS. 1-9 include diffusing heat possessed by return fuel flow and diffusing any bubbles generated by any return fuel, such as those generated upon being discharged into reservoir 38. Another advantage is that within reservoir 38, diffuser 26 may be arranged longitudinally parallel or approximately longitudinally parallel to fuel pump 36 to achieve compact fuel module packaging. Another advantage is that because a mounted diffuser 26 is not required to contact any surface of reservoir 38, such as a bottom wall 82 (FIG. 8), no vibrations from delivery of returning fuel into reservoir 38 is transmitted by diffuser 26 to reservoir walls; that is, diffuser 26 does not contact any reservoir 38 or fuel module structure except where diffuser 26 attaches to an interior fuel inlet pipe (or flange 60).

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Spatially relative terms, such as "inner," "outer," "beneath", "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fuel pump module comprising:

a flange;

a fuel inlet pipe that passes through the flange;

a fuel diffuser attached to the fuel inlet pipe; and a fuel cylinder located completely around part of a length of the fuel diffuser, the fuel cylinder defining a plurality of apertures at a first end of said fuel cylinder and an open end at a second end of the fuel cylinder opposite the first end.

2. The fuel pump module according to claim 1, further comprising:

a reservoir, wherein the fuel diffuser protrudes into an interior volume of the reservoir.

3. The fuel pump module according to claim 1, wherein the fuel cylinder is attached to an interior bottom surface of the reservoir.

4. The fuel pump module according to claim 1, wherein the fuel diffuser and a reservoir bottom define a gap therebetween.

5. The fuel pump module according to claim 1, wherein the plurality of apertures extend through a sidewall of the fuel cylinder.

6. The fuel pump module according to claim 1, further comprising:

a jet pump; and a jet pump supply tube connected to the fuel inlet pipe and the jet pump.

7. The fuel pump module according to claim 1, wherein the plurality of apertures extend through an end wall of the fuel cylinder.

8. A fuel pump module to mount to a fuel tank, the fuel pump module comprising:

a flange residing on a top surface of the fuel tank;

a fuel inlet pipe that passes through the flange;

a reservoir residing proximate a bottom interior surface of the fuel tank;

a fuel diffuser attached to the fuel inlet pipe, wherein the fuel diffuser protrudes into an interior volume of the reservoir; and a fuel cylinder surrounding at least part of a longitudinal length of the fuel diffuser, the fuel cylinder defining a plurality of apertures at a first end of said fuel cylinder and an open end at a second end of the fuel cylinder opposite the first end.

9. The fuel pump module according to claim 8, wherein the second end is attached to a top surface of a bottom wall of the reservoir.

10. The fuel pump module according to claim 8, wherein the fuel diffuser and a reservoir bottom define a gap therebetween.

11. The fuel pump module according to claim 8, wherein the plurality of apertures extend through a sidewall of the fuel cylinder.

12. The fuel pump module according to claim 8, further comprising:

a jet pump; and a jet pump supply tube connected to the fuel inlet pipe and the jet pump.

13. The fuel pump module according to claim 8, wherein the fuel cylinder is attached at the first end to the fuel inlet pipe.

14. The fuel pump module according to claim 13, wherein the first end of the fuel cylinder is a flat surface that defines the plurality of apertures.

15. The fuel pump module according to claim 14, wherein the fuel inlet pipe passes through the flat surface of the first end.

16. A fuel pump module mountable to a fuel tank, the fuel pump module comprising:

a flange mountable to a top surface of the fuel tank;

a fuel inlet pipe that passes through the flange;

a reservoir residing proximate a bottom interior surface of the fuel tank;

a fuel diffuser attached to the fuel inlet pipe and protruding into an interior volume of the reservoir; and a fuel cylinder surrounding more than half of a longitudinal length of the fuel diffuser, the fuel cylinder protruding into an interior volume of the reservoir, the fuel cylinder defining a plurality of apertures at a first end of said fuel cylinder and an open end at a second end of the fuel cylinder opposite the first end.

17. The fuel pump module according to claim 16, wherein:

the fuel diffuser defines a plurality of holes to permit fuel to pass from an inside of the diffuser to an outside of the fuel diffuser, the fuel diffuser and the reservoir bottom define a gap therebetween, and the the plurality of apertures extend through a sidewall of the fuel cylinder.

* * * * *